US006010594A

United States Patent [19]

Henricson et al.

[11] Patent Number: 6,010,594

[45] Date of Patent: Jan. 4, 2000

[54] METHOD OF BLEACHING PULP WITH CHLORINE-FREE CHEMICALS WHEREIN A COMPLEXING AGENT IS ADDED IMMEDIATELY AFTER AN OZONE BLEACH STAGE

[75] Inventors: Kaj Henricson, Helsinki, Finland; Bertil Stromberg, Glens Falls, N.Y.

[73] Assignee: Ahlstrom Machinery Corporation, Helsinki, Finland

[21] Appl. No.: 08/929,082

[22] Filed: Sep. 15, 1997

Related U.S. Application Data

[63] Continuation of application No. 08/530,276, Oct. 18, 1995, abandoned.

[30] Foreign Application Priority Data

Mar. 3, 1993 [FI] Finland ..... 930954

[51] Int. Cl.[7] ..... D21C 9/153; D21C 9/16

[52] U.S. Cl. ..... 162/55; 162/65; 162/72; 162/76; 162/78; 162/90

[58] Field of Search ..... 162/37, 40, 55, 162/60, 65, 72, 78, 82, 76, 90, 24

[56] References Cited

U.S. PATENT DOCUMENTS

| | | | |
|---|---|---|---|
| 4,188,260 | 2/1980 | Rowlandson et al. | 162/60 |
| 4,220,498 | 9/1980 | Prough | 162/60 |
| 4,310,384 | 1/1982 | Meredith et al. . | |
| 4,450,044 | 5/1984 | Fritzvold et al. | 162/65 |
| 4,529,479 | 7/1985 | Tuomi | 162/60 |
| 5,116,423 | 5/1992 | Kokkonen et al. . | |
| 5,179,021 | 1/1993 | DuManoir | 162/72 |
| 5,310,458 | 5/1994 | Lundgren et al. | 162/76 |
| 5,567,262 | 10/1996 | Phillips et al. . | |
| 5,567,279 | 10/1996 | Phillips et al. . | |
| 5,607,545 | 3/1997 | Henricson et al. | 162/65 |

FOREIGN PATENT DOCUMENTS

| | | |
|---|---|---|
| 2028788 | 5/1991 | Canada . |
| 512978 | 11/1992 | European Pat. Off. . |

OTHER PUBLICATIONS

Henricson et al, "New Generationm Kraft Pulping and Bleaching Technology", Apr. 1992.

*Primary Examiner*—Steven Alvo
*Attorney, Agent, or Firm*—Nixon & Vanderhye P.C.

[57] ABSTRACT

Kraft pulp is bleached to an acceptable brightness (e.g. 86 ISO or more) without using chlorinated organic compounds, yet the strength of the produced pulp remains commercially acceptable. In the manufacture of pulp, the pulp which is cooked and oxygen delignified to a kappa number of 14 or less, and then is bleached with ozone at a medium consistency. After the ozone treatment, heavy metals are removed from the pulp, and then the pulp is led to oxygen and/or peroxide treatment, which is followed by a second ozone bleaching stage. The sequence (ZT) (EOP) (ZP) is preferred.

37 Claims, 7 Drawing Sheets

METHOD OF BLEACHING PULP WITH CHLORINE-FREE CHEMICALS WHEREIN A COMPLEXING AGENT IS ADDED IMMEDIATELY AFTER AN OZONE BLEACH STAGE

This is a continuation of application Ser. No. 08/530,276, filed Oct. 18, 1995 now abandoned.

BACKGROUND AND SUMMARY OF THE INVENTION

The present invention relates to a new kind of a method of producing pulp by using chlorine-free chemicals. The invention is especially related to ozone bleaching of pulp without preceding removal of heavy metals.

Different regulations and marketing requirements have set higher and higher demands on producers of kraft pulp to decrease or completely eliminate organic chlorine compounds in pulp products and effluents from bleaching. In order to be able to fulfill these demands the use of chlorine gas or any other compound containing chlorine (e.g. chlorine dioxide) should be avoided. When avoiding the use of chlorine-based bleaching chemicals, it is extremely difficult to obtain the desired brightness especially if the manufactured pulp has been given acceptable strength requirements. Consequently, lignin must be removed, for example, with oxygen. By using multi-stage oxygen delignification advantages have been achieved in delignification and in selectivity, especially when chelating is added to limit the amount of harmful metallic ions, and especially when between stage washing is included in the process (see U.S. Pat. No. 4,946,556). Practical hindrances, however, restrict both the delignification ad the quality of the pulp produced merely by oxygen delignification, especially if followed by an ozone bleaching stage.

So far a common and typical purpose of chlorine-free bleaching methods has been to remove heavy metals from the pulp as completely as possible prior to ozone treatment, since heavy metals are known to destroy ozone as taught by EP-A-0 512 590. Typical bleaching sequences by which pulp has earlier been bleached, are, for example, OOAZEZPZ, OAZEZPZ, OOAZEZP and OAZEZP. These sequences thus include one or by which pulp has earlier been bleached, are, for example, OOAZEZPZ, OAZEZPZ, OOAZEZP and OAZEZP. These sequences thus include one or more oxygen bleaching stages (O), an A-stage (acid washing), an ozone stage (Z), an extraction stage (E), a second ozone stage (Z) and a peroxide stage (P), and possibly a third ozone stage (Z). In the acid stage (A) prior to the first ozone stage heavy metals are removed, which are flushed away, when a portion of the wash filtrate is removed. The extraction stage (E) may be an oxidizing peroxide extraction stage or a conventional oxidizing extraction stage. The ozone bleaching stages are preferably carried out with pulp having the consistency of about 5–18%.

It is characteristic of the above mentioned sequences that they include at least five washing stages, in other words bleaching stages alternate with washing stages, i.e. washers, by which the chemicals separated from the fibers as reaction products or otherwise in each bleaching stage are removed from the suspension. Since the washers form a considerable part of the investment costs in a bleaching plant, the number of the washers should, of course, be limited as much as possible, if it is only possible without risking the quality of the final product.

In the same connection chemicals necessary for some bleaching reactions, such as magnesium (Mg), can also be removed from the pulp, which requires addition of magnesium subsequent to the ozone treatment.

Other multi-stage bleaching sequences have been described for instance in EP patent applications EP-A-0 426 652, EP-A-0 512 978 and EP-A-0 402 335.

EP-A-0 426 652 discloses several bleaching sequences where ozone has been used in combination with peroxide and oxygen. For instance, sequences like EOP-Z-PE-Z-PE, EOP-Z-PE, O-Z-EO-Z-P, O-Z-EOP-Z-P and O-Z-EO-Z-D were discussed. However, the publication does not take into account the presence of heavy metals in the pulp in spite of the fact that at least one of the examples discusses bleaching of kraft pulp by means of a peroxide containing compound.

EP-A-0 512 978 discloses a multi-stage bleaching process using both ozone and peroxide for bleaching pulp. The document does not pay any attention to the removal of heavy metals from pulp before bleaching with peroxide.

EP-A-0 402 335 discloses a process for bleaching lignocellulose-containing pulps by means of peroxide containing substance. The main teaching of the document is to alter the trace metal profile of the pulp by means of a separate treatment with a complexing agent. In other words, the document teaches the importance of treating pulp prior to a peroxide stage in a separate metal removing stage. The document further teaches that the treatment comprises a washing stage between the treatment with complex formers and the peroxide stage.

On the other hand, the previously used chlorine has also prevented a screening stage subsequent to bleaching from being combined with the bleaching plant, because in chlorine bleaching the screening and/or vortex cleaning treatment of pulp would lead to serious corrosion problems. Thus it has been necessary to carry out the vortex cleaning and/or screening as a separate stage. A conventional bleaching+ screening plant has thus included four or five bleaching stages and one screening and/or vortex cleaning stage, which the washing stage separates from each other. The present invention compresses these five to six stages into three stages and thus almost halves the investment costs of a bleaching plant and a screening plant.

By utilizing the present invention it is possible to eliminate the above mentioned disadvantages occuring with the removal of heavy metals and the omission of screening in the prior art technique. At the same time a bleaching plant is provided, which includes only three washing stages.

It is characteristic of the method in accordance with the present invention that pulp is bleached with a sequence beginning with ozone and without the removal of heavy metals preceding the ozone stage.

It is characteristic of another embodiment of the method in accordance with the present invention that pulp is bleached with a three-stage sequence (ZT)(EOP)(ZP) without the removal of heavy metals preceding the sequence, in which (ZT) refers to a bleaching stage with ozone, which also includes treatment of heavy metals and which stage is followed by washing and/or thickening, (EOP) refers to a bleaching stage with peroxide or oxygen and peroxide in alkali conditions and the stage is followed by washing and/or thickening, (ZP) refers to bleaching stage with ozone and peroxide without a between stage washing and which stage is followed by washing and/or thickening.

In each of the stages (ZT), (EOP), and (ZP) there is no interstage washing.

DETAILED DESCRIPTION OF THE DRAWINGS

Figure 1:
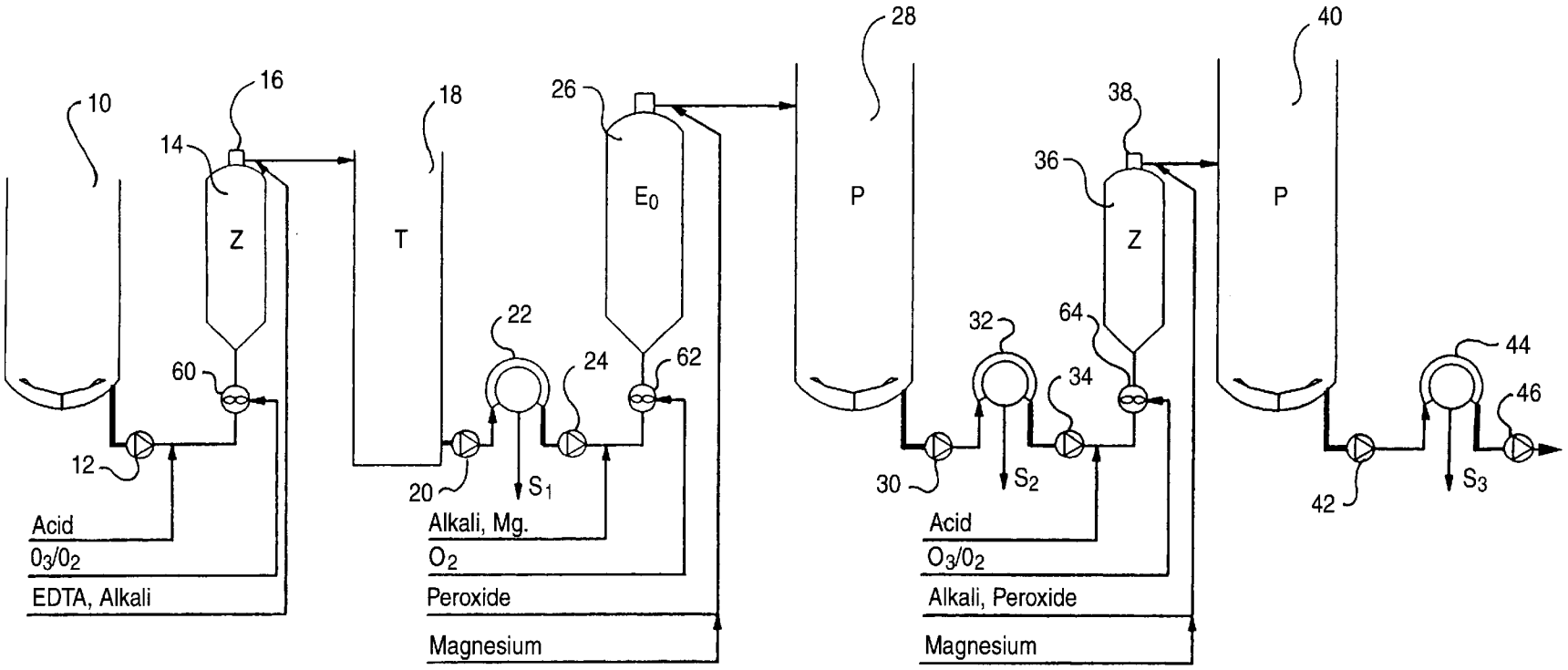
FIG. 1 schematically illustrates a bleaching sequence in accordance with a first exemplary embodiment of the invention.

According to the embodiment of FIG. 1, a bleaching sequence is provided using a high consistency pulp tower 10, from which pulp is discharged and fed, for example, with an MC® (i.e. fluidizing) pump 12 into an ozone reactor 14, from which pulp is preferably discharged by means of a gas separator 16 into a first reaction tower 18. Pulp is preferably discharged from tower 18 into a washer 22 by means of an MC® pump 20. The washer may be a conventional DRUM DISPLACER® washer or a conventional pressure diffuser. Pulp is preferably pumped from washer 22 by an MC® pump 24 into an oxygen reactor 26, and from reactor 26 into a second reaction tower 28. From tower 28 pulp is fed, preferably by an MC® pump 30, to a second washer 32 (preferably a DRUM DISPLACER®) washer, from which pulp is further pumped with an MC® pump 34 into a second ozone reactor 36 and further therefrom through a as separator 38 to a third reaction tower 40. From tower 40 pulp is pumped with an MC® pump 42 into a third washer 44 (preferably a DRUM DISPLACER®) washer.

As also seen in FIG. 1, ozone (in a carrier gas) is mixed with pulp by a mixer 60 prior to the first ozone reactor 14. Similarly, oxygen may be mixed prior to the oxygen reactor 26 with mixer 62 and the mixture of ozone and carrier gas prior to the second ozone reactor 36. The mixers 60, 62 are preferably AHLMIXER™ type fluidizing mixers, which are able to mix very large amounts of gas into fiber suspensions, including medium consistency suspensions.

Furthermore FIG. 1 teaches how, in order to adjust the pH value of the pulp for the first ozone stage and the removal of heavy metals subsequent thereto, acid may be supplied into the pulp, for example, in the pump 12. Similarly, prior to the removal of heavy metals in the first reaction tower 18 complex formers, such as EDTA, and/or alkali may be added to the pulp. If too much magnesium is removed from the pulp by washer 22, it may be added, for example, with the alkali either in pump 24 and/or in the discharge from the oxygen reactor 26, or in any other appropriate way. Another possibility to adjust the pH of the pulp for the second ozone treatment is to feed acid subsequent to the second washer 32 in pump 34 or in some other suitable way. Also prior to feeding the pulp into the third reaction tower 38 alkali, peroxide and/or magnesium may be added into the pulp, as illustrated in FIG. 1.

Figure 2:
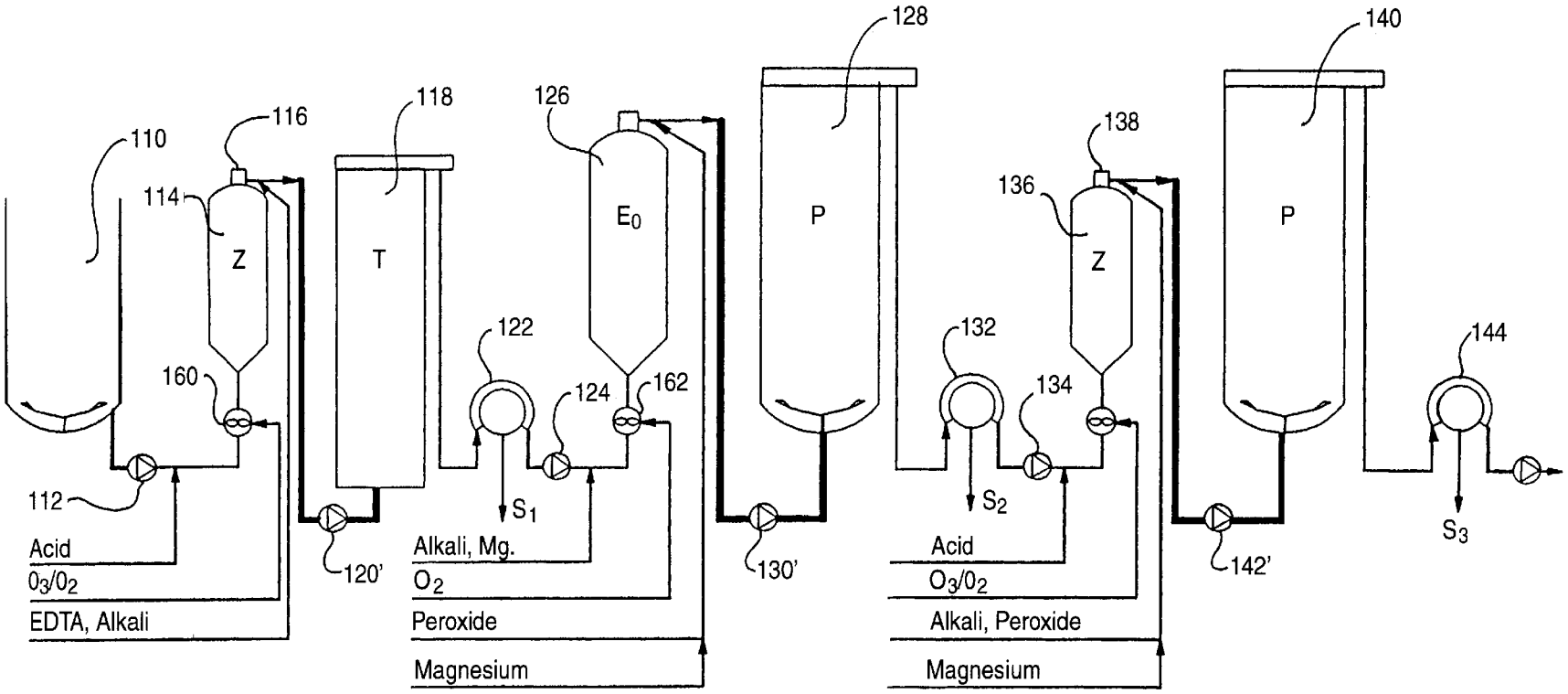
FIG. 2 schematically illustrates a bleaching sequence in accordance with a second embodiment of the invention.

All the reaction towers 18, 28 and 40 in FIG. 1 are shown as of the down flow type. Alternatively, they may be of the up flow type, as is shown in FIG. 2. The only significant difference between FIGS. 1 and 2 is the flow direction of the reaction towers. In the FIG. 2 embodiment components functionally equivalent to or the same as the components in the FIG. 1 embodiment are illustrated by the same reference numeral, only preceded by a "1". Also pumps 20, 30 and 42 of FIG. 1 are replaced by pumps 120', 130' and 142', because they have been relocated at the other side of the reaction tower, in other words; instead of feeding washers 22, 32 and 44 as illustrated in FIG. 1 they feed pulp to the reaction towers 118, 128 and 140 in the embodiments of FIG. 2.

In the process in accordance with the invention pulp is cooked, for example with a continuous EMCC digester, sold by Kamyr Inc., of Glens Falls, N.Y., to a low kappa number, whereafter the kappa number is further decreased by oxygen bleaching to a value of about 14 or below. By utilizing efficient cooking, hot alkali extraction and oxygen bleaching a kappa range of 14–5 is obtained both with soft wood and birch. Usually a kappa number of 14 is sufficient in order to carry our the final bleaching with chlorine-free bleaching chemicals and yet reach a full brightness defined by ISO 86 (preferably ISO 88). Thus also the method in accordance with the present invention may be utilized succesfully to finally bleach pulp prebleached to kappa number 14.

The kraft pulp is bleached subsequent to the pulp washing and according to the invention without a separate removal of heavy metals, for example, with a sequence in accordance with FIG. 1, which is described more in detail below. Pulp may be treated, if so required, with enzymes prior to the sequence in accordance with the present invention. Pulp is brought from the high consistency pulp tower 10 to the first bleaching stage, which is a (ZT) stage. In the Z portion of the (ZT) stage pulp is bleached with ozone, the dosing being about 2–10 kg/adt, pH about 2–7, and temperature about 40–70° C. The pH value of pulp is adjusted by adding acid to the bottom of the high consistency tower 10, pump 12 (or the discharge to pump 12 as seen in FIG. 1), or chemical mixer 60. The ozone having reacted, the residual gas is removed from the pulp preferably in a gas separator 16 and the treatment of heavy metals begins in the first reaction tower 18 in the T portion of the (ZT) stage.

The T portion of the (ZT) stage may be carried out, for example, in the following ways. The first alternative is to allow the pH value of the pulp to decrease to the range of 2–4, whereby the majority of the heavy metals are dissolved into the filtrate phase and may be washed off in the thickener or washer 22 following that stage. The disadvantage here is that the majority of the magnesium (Mg) is also discharged, so that it is possible that magnesium must be added to the pulp, mostly in the form of magnesium sulphate, for the oxygen and/or peroxide stages following later on in the sequence.

Another way to carry out the T portion of the (ZT) stage is to use complex formers, for example, EDTA. The T portion of the (ZT) stage is then carried out in the pH range of about 4–7 and it is advantageous also to have the pH of Z portion of the (ZT) stage preceding T portion above 4. In this way, manganese (which is harmful in the oxygen stages) may be washed off without the magnesium being discharged, so that less magnesium addition (or even no magnesium addition) is necessary in the oxygen and peroxide stages of the final bleaching.

As is described above, the actual metal treatment (T portion of the (ZT) stage) is not carried out prior to the Z portion. Previously this has been considered necessary. Tests with medium consistency ozone treatment have shown that the bleaching reactions with ozone are so rapid that heavy metals do not have time to destroy any significant amount of ozone.

If so required also enzymes may be added in the T portion of the (ZT) stage. Filtrate $S_1$ of the washer 22 subsequent to the (ZT) stage may be brought to pulp washing prior to the (ZT) stage, or passed to the sewer or to the recovery of cooking chemicals.

The (ZT) stage is followed in FIG. 1 by an (EOP) stage. In this stage the oxygen dose is about 2–6 kg/adt and the peroxide dose about 10–20 kg/adt. In some special cases it is possible to run the process completely without oxygen. Temperature in the (EOP) stage is about 60–95° C., pH about 9–12, and the duration is about 2–8 hours. If required, magnesium may be added as a protective chemical. The (EOP) stage is followed by washing, which gives filtrate $S_2$. The filtrate $S_2$ may be taken to pulp washing prior to or subsequent to the (ZT) stage, sewer, or recovery of chemicals.

The (EOP) stage is followed in FIG. 1 by a second ozone bleaching stage, i.e. an (ZP) stage. The ozone portion of the (ZP) stage is normally carried out in the processes in accordance with the prior art in cold, acid conditions in order to have the ozone react properly. Correspondingly, the P portion of the (ZP) stage is carried out according to the teachings of the prior art in hot, alkali conditions in order to have the peroxide react properly. Thus the combination thereof in an economically advantageous way according to the present concepts is conventionally considered impossible. In the (ZP) stage the following conditions may be utilized:

In the Z portion of the (ZP) stage the ozone dose is small, below 3 kg/adt and the purpose of the ozone is only to activate. Although disadvantageous conditions are used and a part of the ozone reacts poorly, this is insignificant, because the dose is small. Ozone is thus mainly used for the activation of the bleaching stage. The temperature in the ozone stage may be 50–80° C., preferably, for example, 60–70° C. The pH is 4–10, preferably about 6–10.

The dose in the P portion of the (ZP) stage is also small, usually less than 10 kg/adt. Normally about 3–7 kg/adt is sufficient. Thus the temperature in the peroxide stage may be dropped to the range of 60–80° C., preferably to 70–80° C. The pH is 9–11, preferably about 10. The duration is about 1–6 hours.

Thus the conditions of Z and P portions of the (ZP) stage are brought close to each other and washing and heating between the Z and P portions of the (ZP) stage are avoided. Moreover, small acid and alkali amounts are sufficient for the pH-control in the Z and P portions of the (ZP) stage. In some cases no between stage heating and/or acid is/are required.

After the (ZP) stage the pulp is washed and a filtrate $S_3$ is obtained. The filtrate $S_3$ may be used for the washing of pulp in connection with the earlier bleaching stages, discharged to the sewer, or led to the recovery of cooking chemicals.

Figure 3:
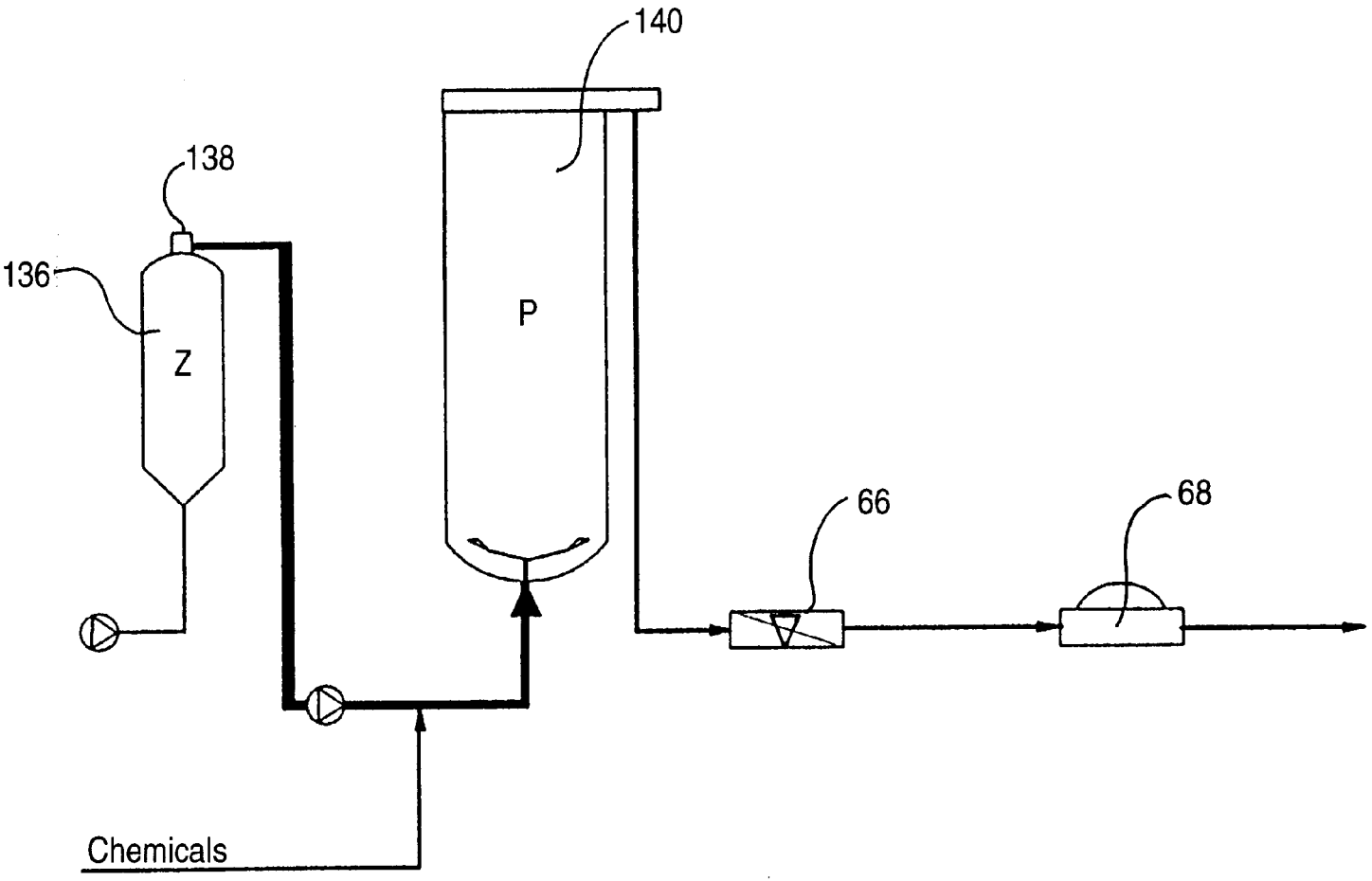
FIG. 3 schematically illustrates the later part of a bleaching sequence in accordance with a third embodiment of the invention.

According to yet another embodiment, shown in FIG. 3, the process in Accordance with the present invention is significantly changed by repositioning of the equipment. For example, a vortex cleaner 66 and/or a screening plant may be added according to FIG. 3 to the last stage of the bleaching plant to precede the thickener/washer 68, which in this case does not have to be an MC® washer, as in the earlier embodiments. Pulp is diluted to the consistency range of about: 0.5–1.5% after the P-tower 140, when vortex cleaning or screening with a slotted screen is used. On the other hand, when screening with a perforated screen, a dilution to about 2–4% is usually sufficient. Subsequent to vortex cleaning or screening, the pulp is thickened and washed—usually with a suction filter 68. Previously pulp had to be diluted after washing to a screening consistency and thickened again after screening to a medium consistency.

Figure 4:
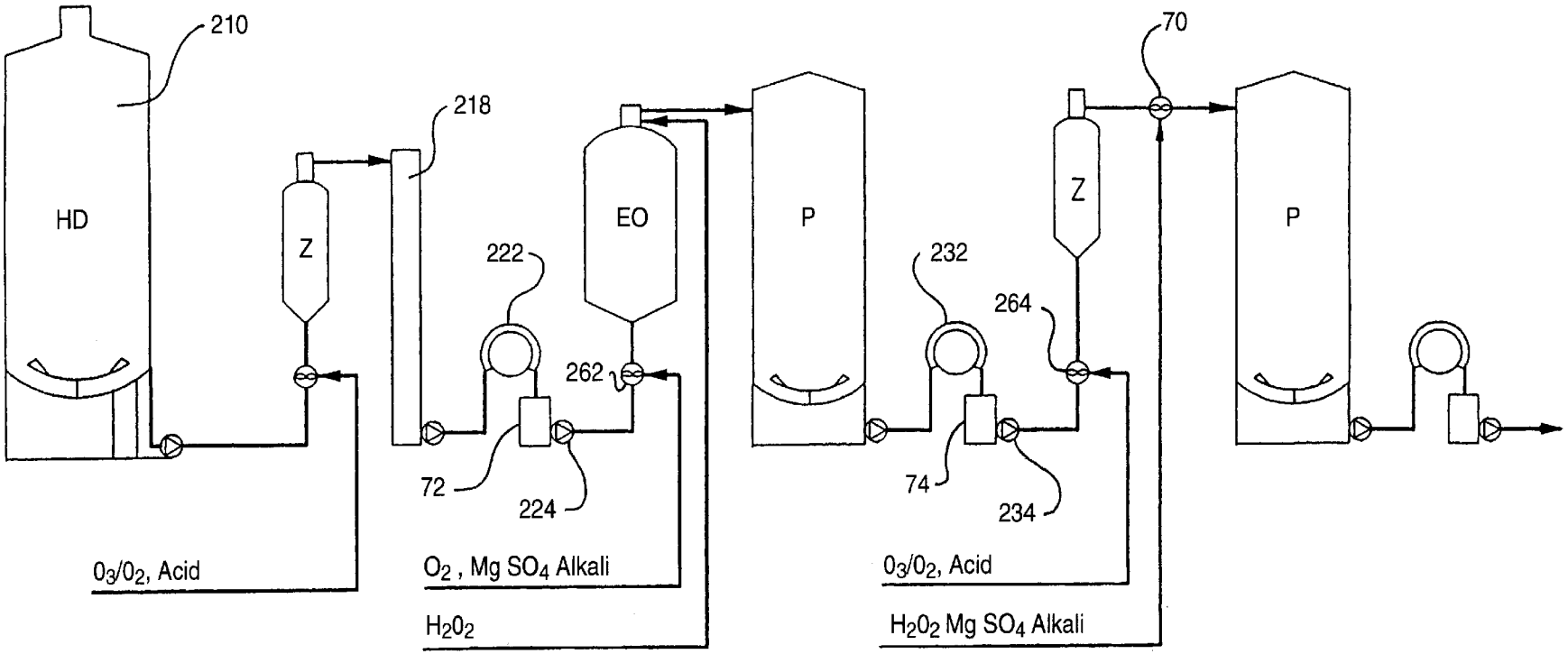
FIG. 4 schematically illustrates another bleaching sequence in accordance with the present invention, and especially portions thereof where acid and/or alkali may be added.

In the embodiment illustrated in FIG. 4 no EDTA is used, but the removal of metals is carried out with acid in a Z stage and by adding magnesium to the (EOP) and (ZP) stages. The addition may well be done, in the (EOP) stage, in an MC® pump 224, or in an oxygen mixer 262. This may also well be done in the (ZP) stage in an MC® pump 234, an ozone mixer 264, or in a peroxide mixer 70. The necessary total chemical amounts are given in Table 1. Thus the initial kappa number prior to bleaching is presumed to be 10.

TABLE 1

| Stage | Chemical consumption adt | | Duration min. | Temperature ° C. |
|---|---|---|---|---|
| Z | $O_3$ | 0.5 | 2 | 40–50 |
| E | $O_2$ | 0.4 | 60 | 80–90 |
| P | $H_2O_2$ | 1.5 | 180 | 80–90 |
| | $MgSO_4$ | 0.4 | | |
| Z | $O_3$ | 0.1 | 2 | 70 |
| P | $H_2O_2$ | 0.4 | 180 | 70 |
| | $MgSO_4$ | 0.3 | | |

In the practice of the method set forth in Table I, about 20–30 kg of NaOH/adt, and 15–25 kg of $H_2SO_4$/adt is consumed, depending upon water usage.

In addition to the chemicals of Table 1 bleaching may be intensified by utilizing enzymes. Appropriate places for the enzyme treatment are:

HD-tower 210 prior to the (ZT) stage,
Drop leg 218 subsequent to the Z reactor,
Drop leg 72 between washer 222 and the (EOP) stage,
Drop leg 74 between washer 232 and the (ZP) stage.

Figure 5:
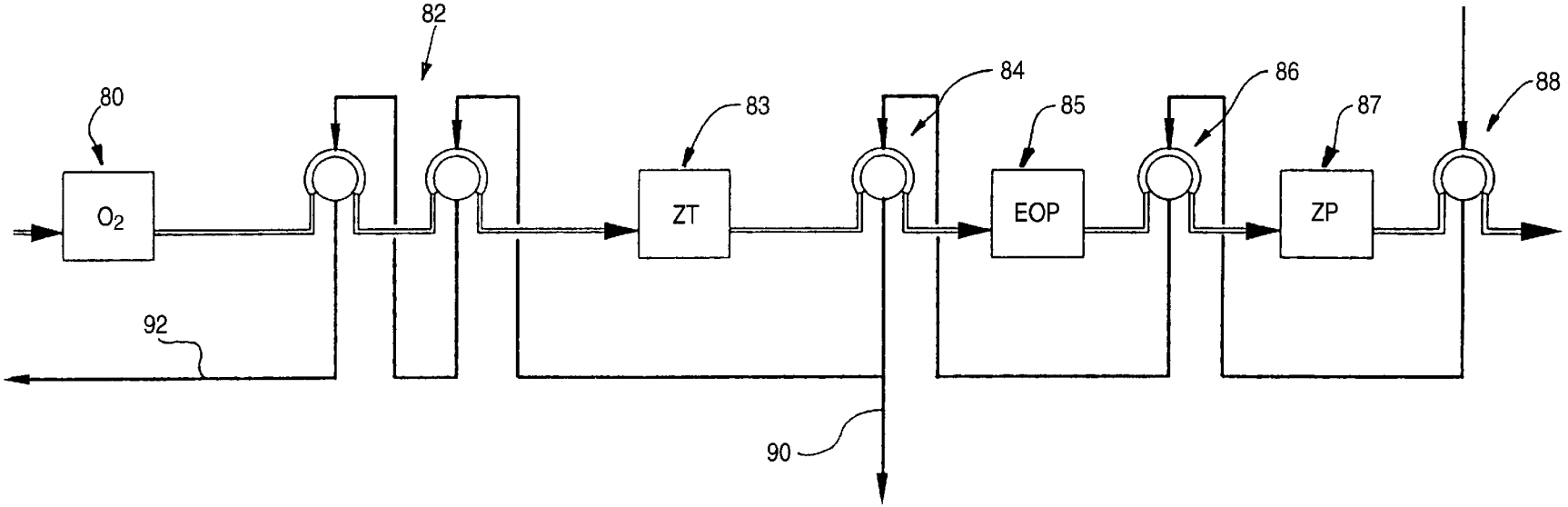
FIG. 5 schematically illustrates a recirculation method for washing filtrates in accordance with another embodiment of the invention.

The effluent flows from the bleaching plant may be decreased by recirculating the filtrates within the process according to FIG. 5. FIG. 5 illustrates an oxygen delignification stage 80, which is followed by a two-stage washing 82. Pulp is transferred from the washing stage to the (ZT) stage 83, and from there via washing 84 to (EOP) stage 85, and from there via washing 86 to the (ZP) stage 87, which is followed by a washing stage 88. The amount of effluent, which is brought to the effluent clarification, discharge channel 90, is 0–5 m3/adt. Part of the effluent may alternatively be transferred to the manufacture of cooking chemicals, via discharge channel 92, to be used instead of fresh water. Thus the amount of effluent that must be treated is minimized.

Figure 6:
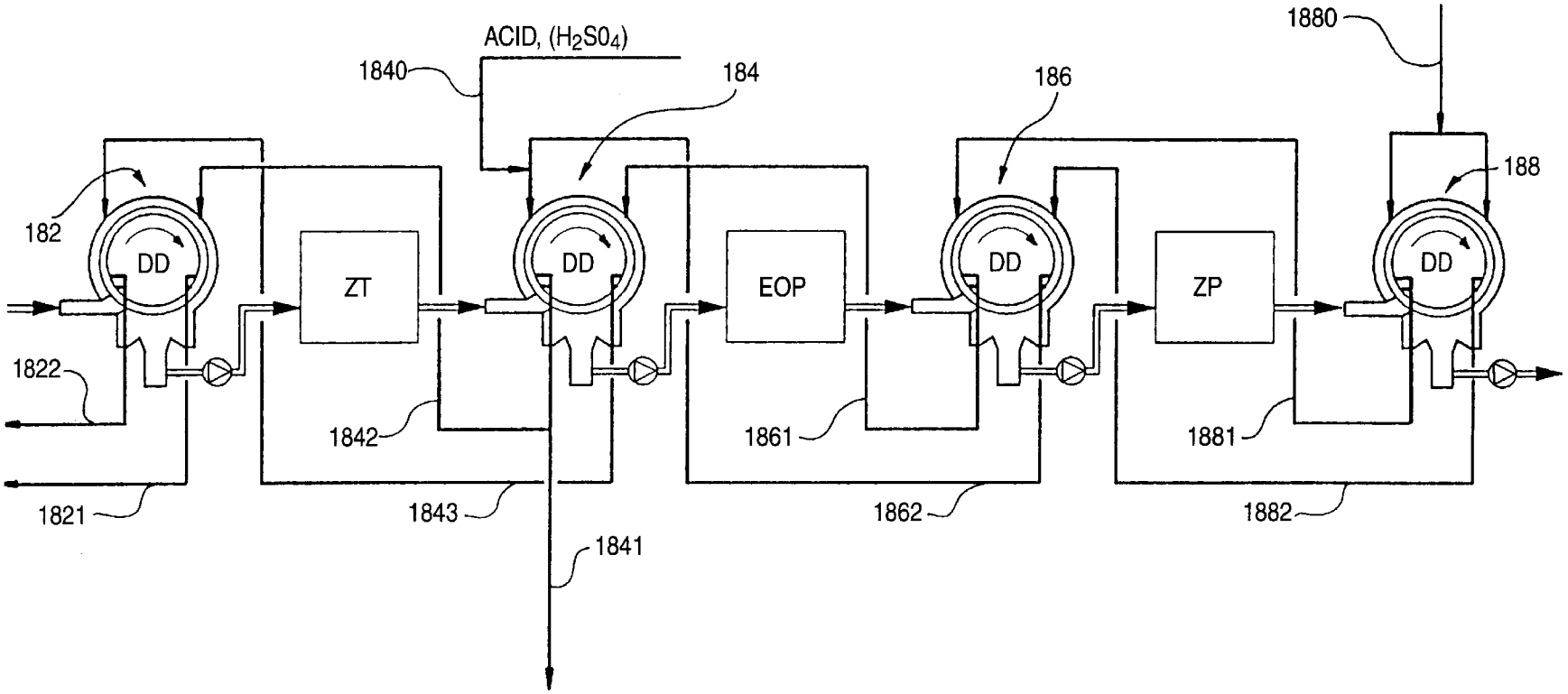
FIG. 6 schematically illustrates a recirculation method for washing filtrates in accordance with the second embodiment of the invention illustrated in FIG. 2.

The reutilization of filtrates illustrated in FIG. 5 may further be intensified by dividing the filtrates from the washer into two fractions with different pH according to FIG. 6. FIG. 6 utilizes the reference numbers of FIG. 5 with a preceding "1". The washers used in FIG. 6 are manufactured and marketed by A. Ahlstrom Corporation, and known as DRUM DISPLACER® washers. For example, the pulp for the last washer 188 comes from the alkali (ZP) stage. Then the first outwashed filtrate 1881 is clearly alkaline and the filtrate 1882 coming out later is less alkaline or even neutral, because water 1880 flowing to the last washer 188 is generally neutral or slightly acid.

In this way two circulation waters 1881 and 1882 of different pH values are obtained, which may be used to adjust the pH of the pulp appropriate before the bleaching sequence, or a particular stage of one bleaching sequence. Filtrates 1881 and 1882 of the last washer 188 in FIG. 6 are brought to the preceding washer 186 in a way that drops the pH of the pulp prior to the (ZP) stage. Thus acid and alkali are saved in the bleaching plant. In the embodiment of FIG. 6 two alkali filtrates 1861 and 1862 are obtained from the washer 186 preceding the (ZP) stage, which are supplied to washer the 184 preceding the (EOP) stage. According to FIG. 6 preferably acid ($H_2SO_4$) 1840 is added to the filtrate 1862, whereby the first filtrate obtained from the washer, of which one portion 1841 is led to effluent clarification and the rest 1842 to the washer 182 preceding the (ZT) stage, is acid and the second filtrate 1843 alkaline.

The pH of the filtrates may also be adjusted by adding acid or alkali to them before they are used again. In some cases it may, for example, be necessary to add alkali to the filtrates prior to their being brought to the brown stock washing or it may be necessary to add acid in order to maintain the pH low during the removal of the metals in the (ZT) stage (point 1840). It is possible that heavy metals are thickened again and attach to the fibers, if the pH increases during washing. Thus heavy metals are entrained to the P portion of the (ZP) stage following the Z portion and disturb the peroxide stage. Preferably the pH value is maintained less than 4, or at least maintained at 4, during the removal of heavy metals.

EXAMPLE

In an experiment a DRUM DISPLACER® washer was used to wash the incoming 100° C. pulp with 60° C. water. The washed pulp was discharged from the washer at a temperature of 65° C. The temperatures of the exiting filtrates were 95° C. and 75° C. Consequently, two significantly different filtrates were obtained from one washer. This may be utilized in a bleaching plant to obtain two filtrates having different pH values, because the pH value of the filtrate to some extent correlates to the temperature of the filtrates.

Figure 7:
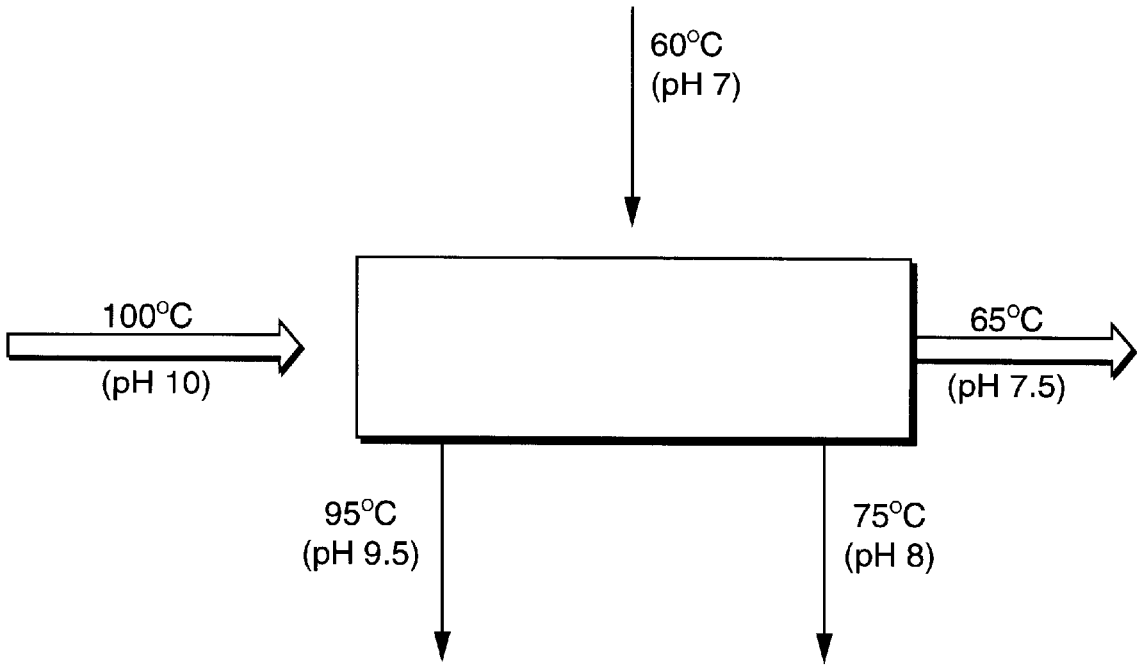
FIG. 7 schematically illustrates results of a research carried out with a DRUM DISPLACER™ washer.

The experiment did not follow the pH value, only the temperature, but based on the temperature distribution the expected pH values are marked in FIG. 7 at respective places.

pH—incoming pulp 10 pH—exiting pulp 7.5 pH—filtrate I 9.5 pH—filtrate II 8.0

Such differences in the pH values between the filtrates is extremely significant when optimizing the chemical consumption of the bleaching plant. The pH values of the filtrates are close to the pH values of the entering and exiting pulp, preferably closer to these than to each other.

As may be seen from the above description, a new method has been developed for bleaching pulp with chlorine-free chemicals in a short sequence without the removal of heavy metals preceding the bleaching sequence. The present invention also includes a new method of arranging the screening subsequent to the pulp bleaching in such a way that a separate washing between the last washing stage and screening/vortex cleaning is unnecessary, but only dilution to screening/cleaning consistency.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of processing cellulose pulp having a consistency between 5–18% containing undesirable heavy metals without the use of chlorine bleaching chemicals, comprising the steps of:

(a) cooking and delignifying comminuted cellulosic fibrous material to produce cellulose pulp having a consistency between 5–18% and a kappa no. of about 14 or less and containing undesirable heavy metals;

(b) bleaching the pulp having a consistency between 5–18% from step (a) using a (ZT) stage having a Z-portion and a T-portion, said (ZT) stage practiced by (i) if the pH of the pulp is not within the range of 2–7, adjusting the pH so that it is within the range of 2–7; (ii) bleaching the pulp with ozone in the Z-portion, and then removing gas from the pulp, and then adding alkali and complexing agent; and (iii) in the T-portion substantially immediately after the degassing, alkali addition, and complexing agent addition following ozone bleaching in substep (ii), without intervening washing, removing undesirable heavy metals from the pulp by using the complexing agent in the T-portion;

(c) after step (b) washing or thickening the pulp; and (d) after step (c), bleaching the pulp in at least one additional stage with peroxide alone, or peroxide in combination with ozone or oxygen, to produce a bleached pulp.

2. A method as recited in claim 1 wherein step (d) comprises practicing an alkaline stage in which peroxide, or peroxide and oxygen, are added.

3. A method as recited in claim 2 wherein step (d) further comprises washing the pulp after the alkaline stage and then practicing a (ZP) stage which comprises a Z-portion followed by a P-portion with no intermediate washing.

4. A method as recited in claim 1 wherein during the practice of substep (ii) about 2–10 kg of ozone per air dried ton of pulp is utilized.

5. A method as recited in claim 1 wherein during the practice of step (b) the pH of the pulp is always between about 2–7, and the temperature is between about 40–70° C.

6. A method as recited in claim 1 wherein during the practice of substep (iii) the pH is about 4–7.

7. A method as recited in claim 2 wherein during the practice of the alkaline stage about 10–20 kg of peroxide is added per air dried ton of pulp.

8. A method as recited in claim 1 comprising the further step between steps (b) and (c) of treating the pulp with a filtrate having a pH which is acidic enough to prevent reattaching of heavy metals.

9. A method as recited in claim 8 wherein said further step is practiced in part by adding acid to filtrate.

10. A method as recited in claim 3 wherein step (d) is practiced to produce a pulp having a brightness of at least about 86 ISO.

11. A method as recited in claim 1 wherein step (d) is practiced to produce a pulp having a brightness of at least about 86 ISO.

12. A method as recited in claim 1 wherein step (a) is practiced by kraft cooking and then oxygen delignification.

13. A method as recited in claim 1 comprising the further step between steps (a) and (b) of treating the pulp with enzymes.

14. A method as recited in claim 1 wherein delignification in step (a) is practiced by using hot-alkali extraction or enzymes.

15. A method as recited in claim 1 wherein step (a) includes washing after delignification, and step (b) substantially immediately follows step (a) without an intervening metal removal stage.

16. A method as recited in claim 1 wherein delignification in step (a) is practiced by using oxygen.

17. A method as recited in claim 16 wherein step (a) includes washing after delignification, and step (b) substantially immediately follows step (a) without an intervening metal removal stage.

18. A method as recited in claim 1 wherein substep (ii) is performed with the pulp at a consistency of between 5–18%.

19. A method as recited in claim 1 wherein step (c) is practiced to produce two filtrates with different pH values from the same washer, and comprising the further step of utilizing the two different filtrates distinctly from each other during the practice of steps (a)–(d).

20. A method as recited in claim 3 wherein during at least one washing stage during the practice of step (c), or step (d), or both (c) and (d), two filtrates with different pH values are produced from the same washing, and comprising the further step of utilizing the two different filtrates distinctly from each other during the practice of steps (a)–(d).

21. A method as recited in claim 1 wherein during at least one washing stage during the practice of step (c), or step (d), or both steps (c) and (d), two filtrates with different pH values are produced from the same washing, and comprising the further step of utilizing the two different filtrates distinctly from each other during the practice of steps (a)–(d).

22. A method as recited in claim 3 wherein said (ZP) stage is practiced using less than 3 kg/adt of ozone and less than 10 kg/adt of peroxide.

23. A method as recited in claim 2 wherein step (a) is practiced by kraft cooking and then oxygen delignification.

24. A method as recited in claim 23 wherein during the practice of the alkaline stage about 10–20 kg/adt of peroxide is added and about 2–6 kg/adt of oxygen.

25. A method as recited in claim 23 wherein during the practice of substep (ii) about 2–10 kg of ozone per air dried ton of pulp is utilized.

26. A method as recited in claim 23 wherein during the practice of step (b) the pH of the pulp is always between about 2–7, and the temperature is between about40–70° C.

27. A method as recited in claim 3 comprising the further steps of immediately screening the pulp after the (ZP) stage, and then washing the pulp after screening.

28. A method as recited in claim 27 wherein said screening step is accomplished by diluting the pulp to a consistency of about 0.5–1.5%, and then treating the pulp in a vortex chamber.

29. A method as recited in claim 27 comprising the further step of diluting the pulp to a consistency of about 0.5–4% prior to screening, and wherein said screening step is practiced at said consistency of about 0.5–4%.

30. A method as recited in claim 2 wherein during the practice of the alkaline stage about 10–20 kg/adt of peroxide is added and about 2–6 kg/adt of oxygen.

31. A method as recited in claim 2 wherein the alkaline stage is practiced by maintaining the pH of the pulp within the range of about 9–12, and maintaining the temperature within the range of about 60–95° C., and wherein the alkaline stage is practiced about 2–8 hours.

32. A method as recited in claim 2 comprising the further step of adding magnesium to the alkaline stage to providing protection for the pulp.

33. A method as recited in claim 3 wherein said (ZP) stage is practiced by adding about 3≧7 kg/adt of peroxide.

34. A method as recited in claim 3 wherein said (ZP) stage is practiced, while ozone is in contact with the pulp, at a temperature of about 50–80° C. and with the pH of the pulp about 4–10.

35. A method as recited in claim 3 wherein during the practice of said (ZP) stage while ozone is in contact with pulp the temperature is maintained between about 60–70° C.

36. A method as recited in claim 3 wherein during the practice of said (ZP) stage while ozone is in contact with pulp the pH of the pulp is maintained within the range of about 6–10.

37. A method as recited in claim 1 wherein enzymes are added to the pulp prior to step (b).

* * * * *

UNITED STATES PATENT AND TRADEMARK OFFICE

CERTIFICATE OF CORRECTION

PATENT NO. : 6,010,594
DATED : January 4, 2000
INVENTOR(S) : Henricson et al.

It is certified that error appears in the above-identified patent and that said Letters Patent is hereby corrected as shown below:

Title page,
Item [73], should read as follows:
-- [73] Assignee: A. Ahlstrom Corporation Noormarkku, Finland --

Signed and Sealed this

Twentieth Day of May, 2003

JAMES E. ROGAN
*Director of the United States Patent and Trademark Office*